US009880507B2

(12) United States Patent
Kamata

(10) Patent No.: US 9,880,507 B2
(45) Date of Patent: Jan. 30, 2018

(54) IMAGE FORMING APPARATUS, IMAGE FORMING SYSTEM, AND IMAGE FORMING METHOD

(71) Applicant: Konica Minolta, Inc., Chiyoda-ku, Tokyo (JP)

(72) Inventor: Yoshihisa Kamata, Hadano (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/953,147

(22) Filed: Nov. 27, 2015

(65) Prior Publication Data

US 2016/0154364 A1 Jun. 2, 2016

(30) Foreign Application Priority Data

Nov. 27, 2014 (JP) ..... 2014-239423

(51) Int. Cl.
*G03G 15/00* (2006.01)

(52) U.S. Cl.
CPC ..... *G03G 15/70* (2013.01)

(58) Field of Classification Search
CPC ..... G03G 15/00; G03G 15/70; G03G 15/231; B65H 85/00; B65H 7/06
See application file for complete search history.

(56) References Cited

U.S. PATENT DOCUMENTS

2013/0258391 A1* 10/2013 Maeda ..... G06K 15/4085 358/1.14
2013/0302044 A1* 11/2013 Yoshioka ..... G03G 21/1695 399/21
2013/0302045 A1* 11/2013 Serizawa ..... G03G 15/231 399/21

FOREIGN PATENT DOCUMENTS

JP 11-180592 A 7/1999

* cited by examiner

*Primary Examiner* — David Banh
(74) *Attorney, Agent, or Firm* — Buchanan Ingersoll & Rooney PC

(57) ABSTRACT

An image forming apparatus includes a sheet feeding unit; an image forming unit; a conveying unit; sheet detectors disposed on a conveyance path to detect a sheet; a sheet ejection unit which, if a jam occurs on the conveyance path, ejects a remaining sheet on the conveyance path after a sheet that has caused the jam is removed; and a control unit which stores, in a storage unit, information representing a confirmed section of the conveyance path, the confirmed section being a section confirmed to have no remaining sheet as a result of ejection of the remaining sheet, and which, if one of the sheet detectors detects a first sheet that has reached the confirmed section after recovery from the jam, allows the sheet feeding unit to feed second and subsequent sheets.

9 Claims, 14 Drawing Sheets

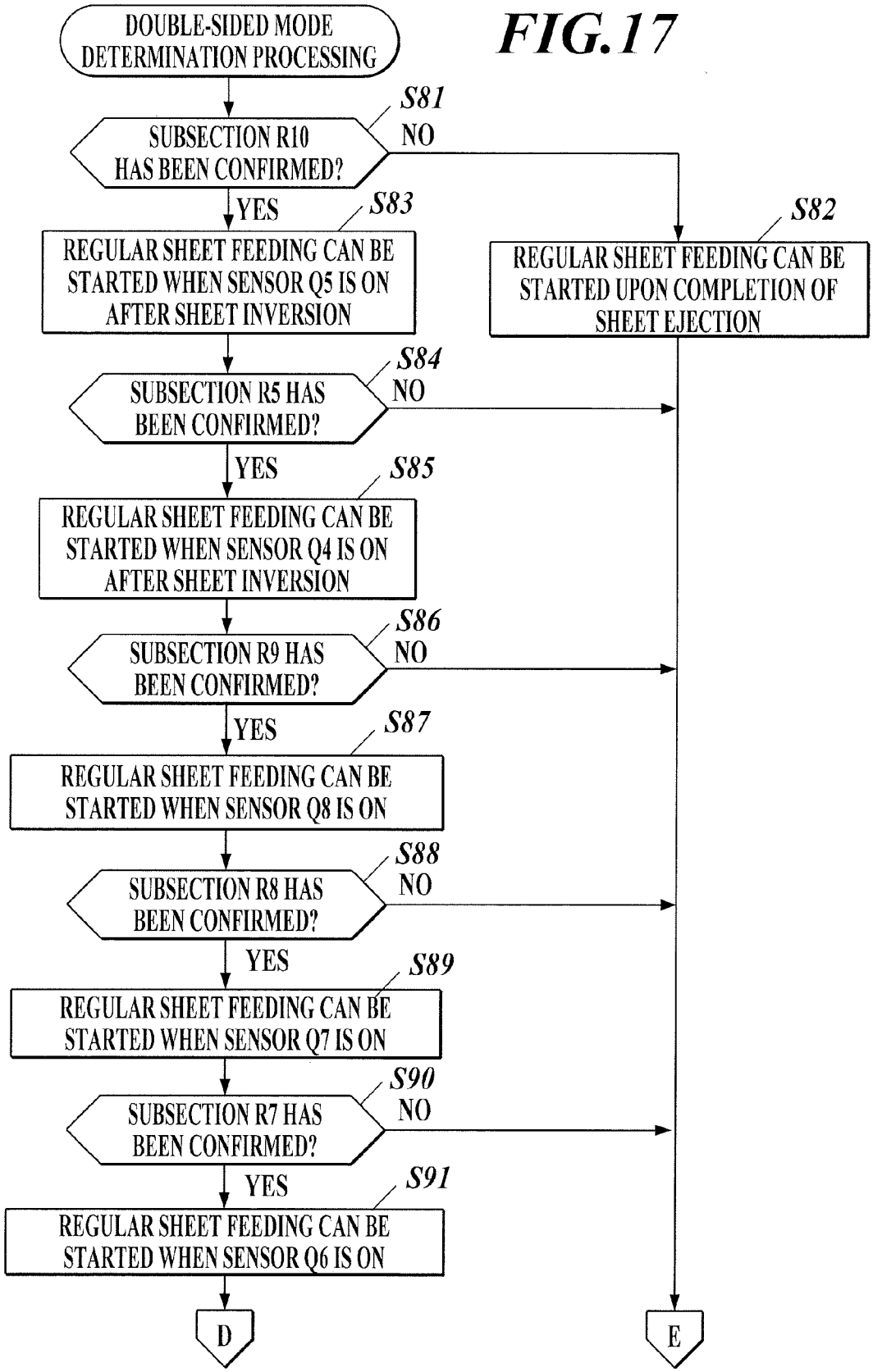
FIG.17
DOUBLE-SIDED MODE DETERMINATION PROCESSING
S81
SUBSECTION R10 HAS BEEN CONFIRMED?
NO
YES
S83
REGULAR SHEET FEEDING CAN BE STARTED WHEN SENSOR Q5 IS ON AFTER SHEET INVERSION
S82
REGULAR SHEET FEEDING CAN BE STARTED UPON COMPLETION OF SHEET EJECTION
S84
SUBSECTION R5 HAS BEEN CONFIRMED?
NO
YES
S85
REGULAR SHEET FEEDING CAN BE STARTED WHEN SENSOR Q4 IS ON AFTER SHEET INVERSION
S86
SUBSECTION R9 HAS BEEN CONFIRMED?
NO
YES
S87
REGULAR SHEET FEEDING CAN BE STARTED WHEN SENSOR Q8 IS ON
S88
SUBSECTION R8 HAS BEEN CONFIRMED?
NO
YES
S89
REGULAR SHEET FEEDING CAN BE STARTED WHEN SENSOR Q7 IS ON
S90
SUBSECTION R7 HAS BEEN CONFIRMED?
NO
YES
S91
REGULAR SHEET FEEDING CAN BE STARTED WHEN SENSOR Q6 IS ON
D
E

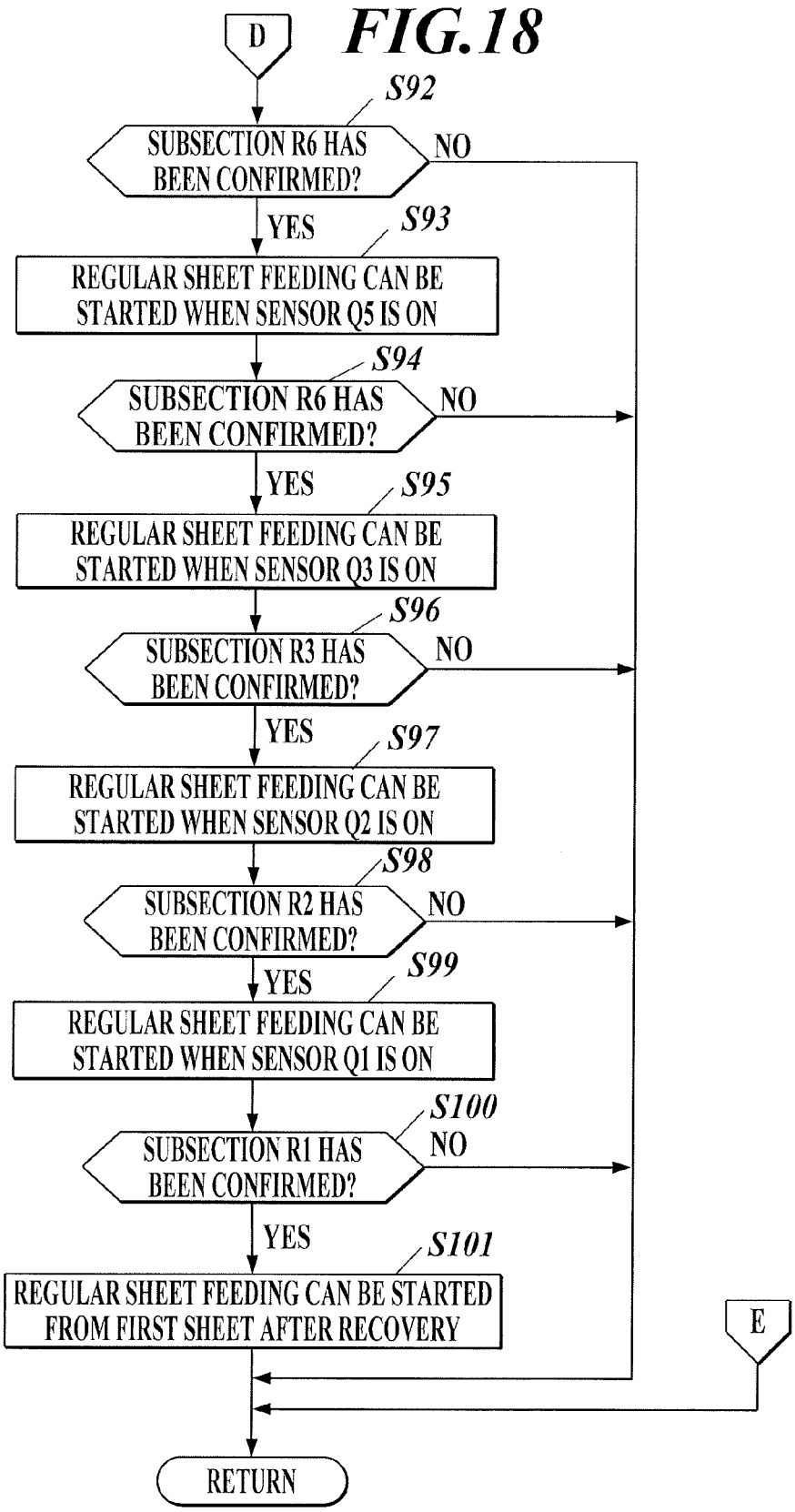
FIG.18
D
S92
SUBSECTION R6 HAS BEEN CONFIRMED?
NO
YES
S93
REGULAR SHEET FEEDING CAN BE STARTED WHEN SENSOR Q5 IS ON
S94
SUBSECTION R6 HAS BEEN CONFIRMED?
NO
YES
S95
REGULAR SHEET FEEDING CAN BE STARTED WHEN SENSOR Q3 IS ON
S96
SUBSECTION R3 HAS BEEN CONFIRMED?
NO
YES
S97
REGULAR SHEET FEEDING CAN BE STARTED WHEN SENSOR Q2 IS ON
S98
SUBSECTION R2 HAS BEEN CONFIRMED?
NO
YES
S99
REGULAR SHEET FEEDING CAN BE STARTED WHEN SENSOR Q1 IS ON
S100
SUBSECTION R1 HAS BEEN CONFIRMED?
NO
YES
S101
REGULAR SHEET FEEDING CAN BE STARTED FROM FIRST SHEET AFTER RECOVERY
E
RETURN

IMAGE FORMING APPARATUS, IMAGE FORMING SYSTEM, AND IMAGE FORMING METHOD

BACKGROUND OF THE INVENTION

1. Field of the Invention

The present invention relates to an image forming apparatus, an image forming system, and an image forming method.

2. Description of Related Art

In order to reduce the burden on users when a jam (paper jam) occurs, a conventional image forming apparatus has an automatic purge function to automatically eject sheets remaining in the apparatus after a user removes only a sheet that has caused the jam. After all the remaining sheets are ejected, the image forming apparatus starts supplying sheets for recovery processing in which image formation resumes from a page that has been spoiled by the jam.

Sensors disposed on the conveyance path to detect sheets are used to determine whether there are any remaining sheets in the apparatus at the time of an automatic purge. The sensors cannot detect sheets if the sheets are between the sensors. In this case, the remaining sheets may be falsely recognized as having been all ejected (i.e., the automatic purge is falsely recognized as having been completed), leading to some sheets in the apparatus remaining to be ejected. If image formation resumes in such a state, a newly fed sheet may hit a sheet remaining on the conveyance path and may cause another jam. A high-speed production printing machine, in particular, would be conveying many sheets at the time of a jam, and it is difficult to confirm whether all the sheets have been ejected.

In view of such problems, a sheet conveying apparatus has been proposed which makes an examination sheet, which is fed by a sheet feed tray, travel through the conveying path after the execution of the automatic purge function before the resumption of printing, thereby checking the existence or non-existence of sheets that remain to be removed by the automatic purge (see Japanese Unexamined Patent Application Publication No. 11-180592).

Unfortunately, the above-mentioned prior art obliges users to wastefully consume sheets because it uses an examination sheet to travel through the conveyance path in order to check for abnormalities on the conveyance path. Further, there is a problem of delay in recovery because the apparatus resumes printing after the completion of the ejection of the examination sheet.

SUMMARY OF THE INVENTION

The present invention has been made in view of the problems in the prior art and aims to check the status of the conveyance path without wasting sheets and to minimize the time required for recovery from jams.

In order to achieve the foregoing object, an image forming apparatus reflecting one aspect of the present invention includes: a sheet feeding unit which feeds a sheet; an image forming unit which performs image formation on the sheet; a conveying unit which conveys the sheet; a plurality of sheet detectors which detect existence of the sheet, the sheet detectors being disposed on a conveyance path; a sheet ejection unit which, if a jam occurs on the conveyance path, ejects a remaining sheet remaining on the conveyance path after a sheet that has caused the jam is removed; and a control unit which stores, in a storage unit, information representing a confirmed section of the conveyance path, the confirmed section being a section confirmed to have no remaining sheet as a result of ejection of the remaining sheet, and which, if one of the sheet detectors detects a first sheet for the image formation that has reached the confirmed section after recovery from the jam, allows the sheet feeding unit to feed second and subsequent sheets.

Preferably, in the image forming apparatus, if a whole of the conveyance path of a sheet to be fed next is the confirmed section, the control unit allows the sheet feeding unit to feed the sheet to be fed next and a subsequent sheet; and if the conveyance path of the sheet to be fed next includes a part other than the confirmed section, the control unit allows the sheet feeding unit to feed the second and subsequent sheets when the sheet detector detects the first sheet that has reached the confirmed section.

Preferably, in the image forming apparatus, if a mode is a single-sided mode when the jam occurs, the control unit determines a section, which is used only in a double-sided mode, of the conveyance path to be the confirmed section, wherein the single-sided mode is a mode in which the image formation is performed on one side of the sheet, and wherein the double-sided mode is a mode in which the image formation is performed on both sides of the sheet.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention.

FIG. 17 is a flowchart showing double-sided mode determination processing.

FIG. 18 is a flowchart showing double-sided mode determination processing.

DESCRIPTION OF THE PREFERRED EMBODIMENTS

First Embodiment

Figure 1:
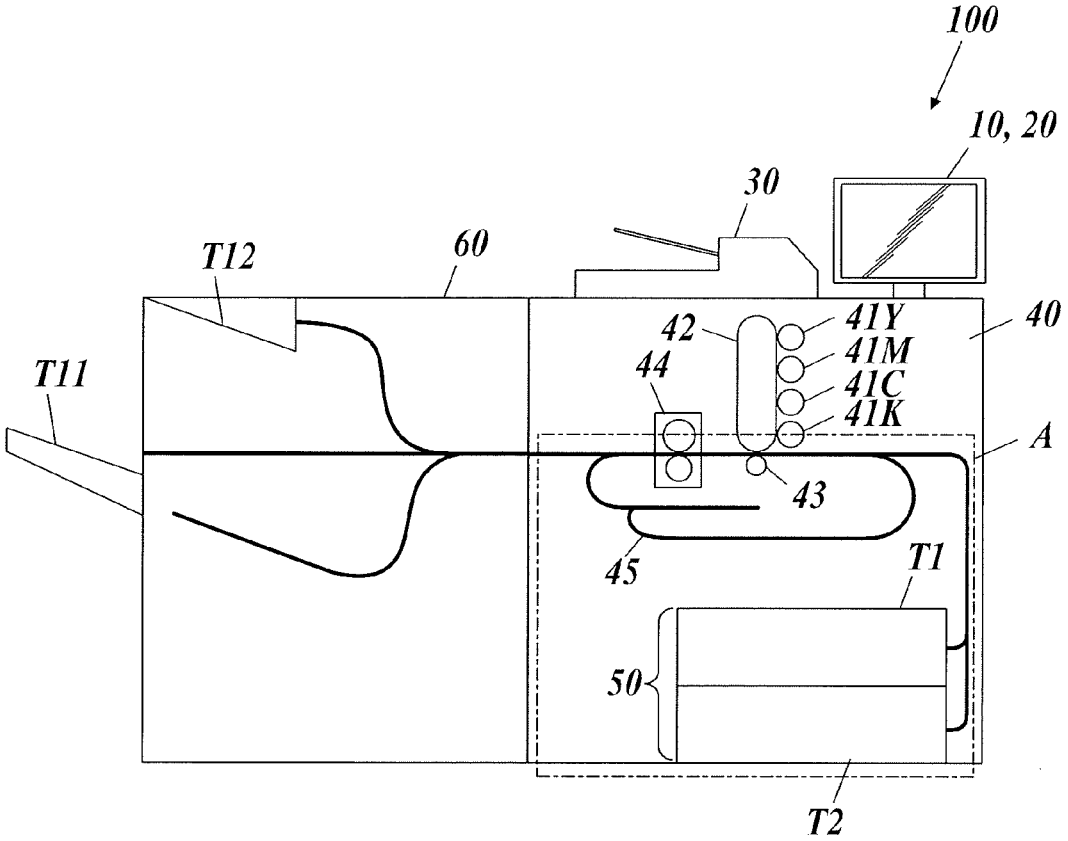
FIG. 1 is a schematic diagram of an image forming apparatus according to a first embodiment of the present invention.

An image forming apparatus according to a first embodiment of the present invention will now be described. The present invention is not limited to the examples shown in the drawings.

FIG. 1 is a schematic diagram of an image forming apparatus 100.

The image forming apparatus 100 is a tandem color image forming apparatus to form color images by electrophotographic processes based on image data obtained by scanning images from documents or received from external devices.

The image forming apparatus 100 includes an operation unit 10, a display unit 20, an image scanning unit 30, an image forming unit 40, a sheet feeding unit 50, and a sheet processing unit 60 etc.

The operation unit 10 includes a touch panel covering the display screen of the display unit 20 and various operation buttons such as numeric buttons and a start button. The operation unit 10 outputs operational signals based on user operations to a control unit 71 (see FIG. 3).

The display unit 20, which is composed of a liquid crystal display (LCD), displays various screens in accordance with the instructions of display signals input from the control unit 71.

The image scanning unit 30 includes an automatic document feeder (ADF) and a scanner etc. The image scanning unit 30 outputs image data obtained by scanning images on documents to the control unit 71.

The image forming unit 40 performs image formation on sheets fed from the sheet feeding unit 50.

The image forming unit 40 includes photoreceptor drums 41Y, 41M, 41C, and 41K for yellow (Y), magenta (M), cyan (C), and black (K), respectively; an intermediate transfer belt 42; a secondary transfer roller 43; a fixing unit 44; and an inverting mechanism 45 etc.

The photoreceptor drum 41Y is uniformly charged and exposed to a laser beam scanning on the photoreceptor drum 41Y based on yellow image data. An electrostatic latent image is thus formed. A yellow toner is then applied to the electrostatic latent image on the photoreceptor drum 41Y for development.

Since the processes for the other photoreceptor drums 41M, 41C, and 41K are the same as that for the photoreceptor drum 41Y except for the color, the explanations for them are omitted.

The toner images of the colors formed on the photoreceptor drums 41Y, 41M, 41C, 41K are sequentially transferred onto the rotating intermediate transfer belt 42 (primary transfer). That is, a color toner image made up of the four-color toner images superposed on top of one another is formed on the intermediate transfer belt 42.

The color toner image on the intermediate transfer belt 42 is transferred, as a group, onto a sheet by the secondary transfer roller 43 (secondary transfer).

The fixing unit 44 includes a heat roller to heat the sheet on which the color toner image has been transferred and includes a pressure roller to apply a pressure to the sheet. The fixing unit 44 fixes the color toner image onto the sheet with heat and pressure.

The inverting mechanism 45 turns a sheet over if image formation is to be performed on both sides of the sheet.

The sheet feeding unit 50 includes sheet feed trays T1 and T2 and feeds sheets to the image forming unit 40. Each of the sheet feed trays T1 and T2 contains sheets of a predetermined type and size, the type and size varying depending on the tray.

The sheet processing unit 60 processes sheets, as appropriate, on which image formation has been performed by the image forming unit 40. Examples of the sheet processing include sorting, stapling, punching, folding, and binding. The sheet processing unit 60 ejects the sheets to the sheet ejection tray T11 or T12.

Figure 2:
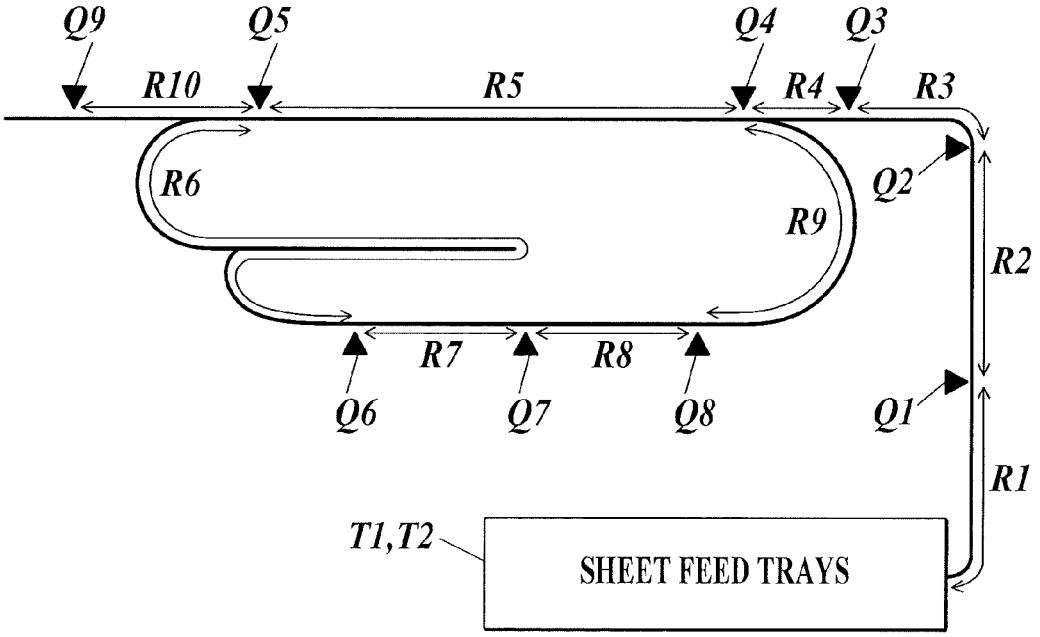
FIG. 2 shows a sheet conveyance path.

FIG. 2 shows the sheet conveyance path, which is indicated by "A" in FIG. 1, of the image forming apparatus 100.

As shown in FIG. 2, the conveyance path includes sensors Q1 to Q9 to detect the existence of sheets. Each of the sensors Q1 to Q9 is ON when detecting a sheet and is OFF when detecting no sheets.

The conveyance path is divided by the sensors Q1 to Q9 into subsections R1 to R10 along the sheet conveyance direction. Specifically, the subsection from the sheet feed trays T1 and T2 to the sensor Q1 is defined as a subsection R1, the subsection from the sensor Q1 to the sensor Q2 is defined as a subsection R2, the subsection from the sensor Q2 to the sensor Q3 is defined as a subsection R3, the subsection from the sensor Q3 to the sensor Q4 is defined as a subsection R4, the subsection from the sensor Q4 to the sensor Q5 is defined as a subsection R5, the subsection from the sensor Q5 to the sensor Q6 is defined as a subsection R6, the subsection from the sensor Q6 to the sensor Q7 is defined as a subsection R7, the subsection from the sensor Q7 to the sensor Q8 is defined as a subsection R8, the subsection from the sensor Q8 to the sensor Q4 is defined as a subsection R9, and the subsection from the sensor Q5 to the sensor Q9 is defined as a subsection R10. The subsections R6 to R9 are used only in a double-sided mode where image formation is performed on both sides of each sheet.

For ease of explanation, the explanation of a conveyance path in the sheet processing unit 60 is omitted, but actually, the conveyance path in the sheet processing unit 60 also includes sensors to detect the existence of sheets.

Figure 3:
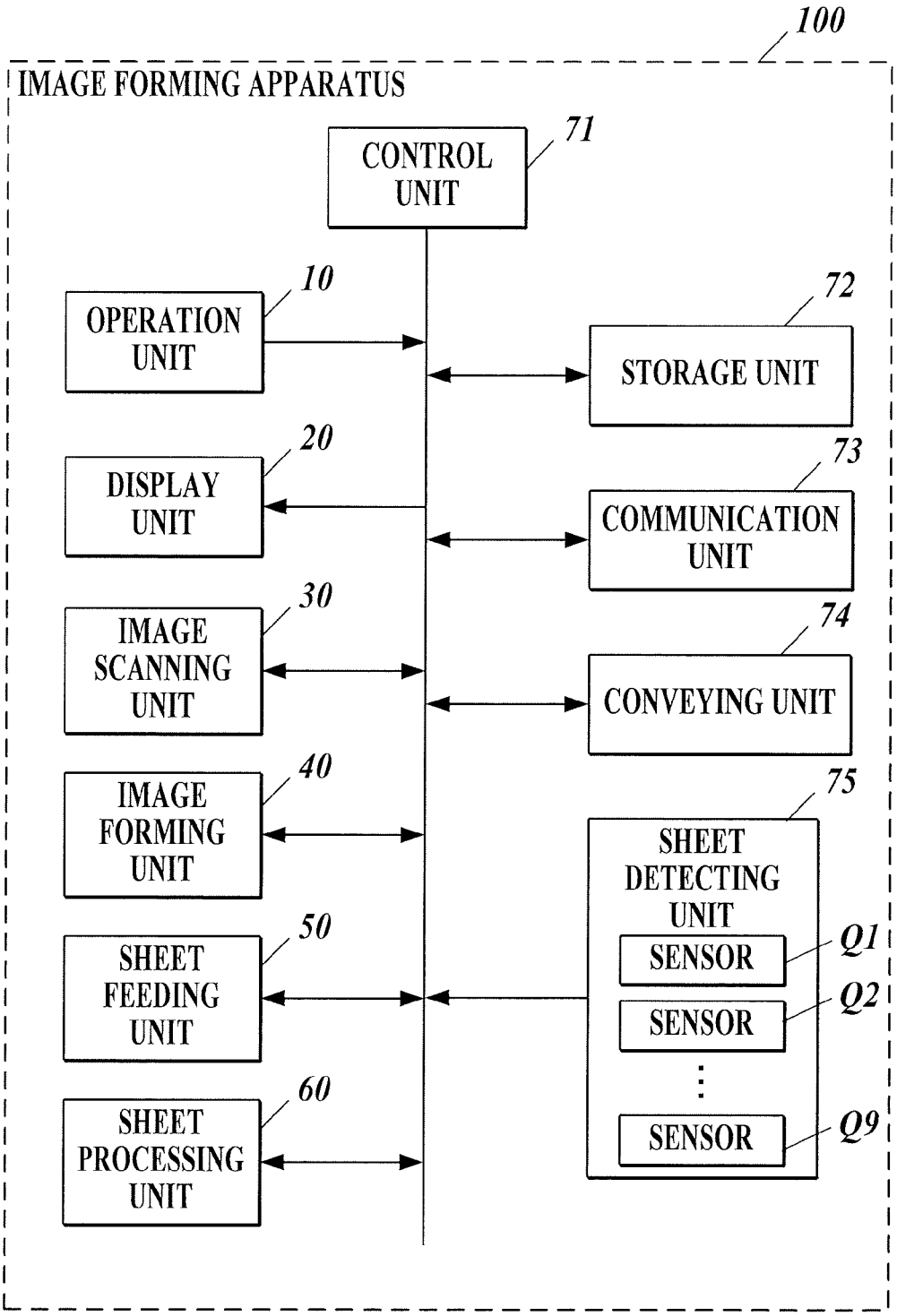
FIG. 3 is a block diagram showing a functional configuration of the image forming apparatus.

FIG. 3 is a block diagram showing the functional configuration of the image forming apparatus 100.

As shown in FIG. 3, the image forming apparatus 100 includes the operation unit 10, the display unit 20, the image scanning unit 30, the image forming unit 40, the sheet feeding unit 50, the sheet processing unit 60, the control unit 71, a storage unit 72, a communication unit 73, a conveying unit 74, and a sheet detecting unit 75 etc. Redundant explanations are not given here for the function units that have already been explained.

The control unit 71 includes a central processing unit (CPU), a read only memory (ROM), and a random access memory (RAM) etc. The CPU loads various processing programs stored in the ROM into the RAM in response to operational signals input from the operation unit 10 or instruction signals received by the communication unit 73. The control unit 71 intensively controls the operations of the units of the image forming apparatus 100 in accordance with the loaded programs.

The storage unit 72 includes a hard disk, a flash memory or the like where various pieces of data are to be stored. For example, in the storage unit 72, conveyance path information is stored for each of the subsections R1 to R10. The conveyance path information refers to information representing whether non-existence of remaining sheets has been confirmed.

The communication unit 73 sends and receives data to and from external devices connected to a communication network, such as a local area network (LAN).

The conveying unit 74 includes conveying rollers to convey sheets. The conveying unit 74 supplies sheets stored in the sheet feed trays T1 and T2 of the sheet feeding unit 50 to the image forming unit 40, and conveys the sheets in the image forming apparatus 100 until the sheets with images formed thereon are ejected to the sheet ejection tray T11 or T12.

The sheet detecting unit 75 includes the sensors Q1 to Q9 disposed on the sheet conveyance path to detect the existence of sheets.

The control unit 71 detects jams and their positions based on the output results of the sensors Q1 to Q9 of the sheet detecting unit 75. Specifically, the control unit 71 detects a jam when a sheet passes a first sensor on the conveyance path but, after the elapse of a certain period of time, is not detected by a second sensor next to and downstream of the first sensor.

When a jam occurs on the conveyance path, the control unit 71 controls the conveying unit 74 to eject remaining sheets remaining on the conveyance path to the outside of the apparatus (automatic purge function) after the sheet that has caused the jam is removed. In other words, the control unit 71 and conveying unit 74 serve as a sheet ejection unit. For example, when a user presses the start button after removing the sheet that has caused the jam, the control unit 71 starts the automatic purge to eject remaining sheets to the sheet ejection tray T12 different from the sheet ejection tray T11 to which sheets are normally ejected.

The control unit 71 checks for subsections with no remaining sheets, i.e., subsections through which sheets can be conveyed properly, based on the output results (ON/OFF) of the sensors Q1 to Q9 of the sheet detecting unit 75. The control unit 71 stores, in the storage unit 72, information (conveyance path information) representing confirmed subsections (confirmed subsection) of the conveyance path confirmed to have no remaining sheets as a result of the ejection of remaining sheets.

Specifically, for each of the subsections R1 to R10, the control unit 71 determines that a sheet has passed the subsection if the front edge of the sheet reaches the sensor on the downstream side (sensor: ON) in the sheet conveyance direction and then the rear edge of the sheet passes the sensor (sensor: OFF). The control unit 71 then determines that no remaining sheets exist on the subsection. The control unit 71 updates the conveyance path information on the subsections that have been determined to have no remaining sheets, among the subsections R1 to R10, into "confirmed".

More specifically, if the front edge of a sheet reaches the sensor Q1 and then the rear edge of the sheet passes the sensor Q1, the control unit 71 determines the subsection R1 to be a confirmed subsection (i.e., a subsection confirmed to have no remaining sheets). If the front edge of a sheet reaches the sensor Q2 and then the rear edge of the sheet passes the sensor Q2, the control unit 71 determines the subsection R2 to be a confirmed subsection. If the front edge of a sheet reaches the sensor Q3 and then the rear edge of the sheet passes the sensor Q3, the control unit 71 determines the subsection R3 to be a confirmed subsection. If the front edge of a sheet reaches the sensor Q4 and then the rear edge of the sheet passes the sensor Q4, the control unit 71 determines the subsection R4 to be a confirmed subsection. If the front edge of a sheet reaches the sensor Q5 and then the rear edge of the sheet passes the sensor Q5, the control unit 71 determines the subsection R5 to be a confirmed subsection. If the front edge of a sheet reaches the sensor Q6 and then the rear edge of the sheet passes the sensor Q6, the control unit 71 determines the subsection R6 to be a confirmed subsection. If the front edge of a sheet reaches the sensor Q7 and then the rear edge of the sheet passes the sensor Q7, the control unit 71 determines the subsection R7 to be a confirmed subsection. If the front edge of a sheet reaches the sensor Q8 and then the rear edge of the sheet passes the sensor Q8, the control unit 71 determines the subsection R8 to be a confirmed subsection. If the front edge of an inverted sheet reaches the sensor Q4 and then the rear edge of the inverted sheet passes the sensor Q4, the control unit 71 determines the subsection R9 to be a confirmed subsection. If the front edge of a sheet reaches the sensor Q9 and then the rear edge of the sheet passes the sensor Q9, the control unit 71 determines the subsection R10 to be a confirmed subsection.

When remaining sheets are ejected out of the apparatus and an automatic purge is completed, the control unit 71 allows the sheet feeding unit 50 to start feeding (recovery sheet feeding) to resume image formation from the page that has been spoiled by a jam. At this time, if the sheet detecting unit 75 detects the first sheet for image formation that has reached a confirmed section (i.e., a section consisting of confirmed subsections and confirmed to have no remaining sheets as a result of the automatic purge) after the recovery from the jam, the control unit 71 determines that no sheets remain in the apparatus and allows the sheet feeding unit 50 to feed the second and subsequent sheets. The second and subsequent sheets are fed at normal intervals.

The control unit 71 checks the conveyance path of the sheet to be fed next by the sheet feeding unit 50. The conveyance path varies depending on, for example, whether the apparatus is in a single-sided mode where image formation is performed on one side of each sheet or in a double-sided mode where image formation is performed on both sides of each sheet. Further, the conveyance path varies depending on the type of sheet processing to be performed on sheets.

If the whole of the conveyance path of the sheet to be fed next is a confirmed section, the control unit 71 allows the sheet feeding unit 50 to feed the next and subsequent sheets. In other words, the sheet feeding unit 50 feeds sheets at normal intervals from the first sheet. If, on the other hand, the conveyance path of the sheet to be fed next includes a part other than a confirmed section, the control unit 71 allows the sheet feeding unit 50 to feed the second and subsequent sheets when the sheet detecting unit 75 detects the first sheet that has reached the confirmed section. The subsequent sheets are fed at normal intervals.

The operations in the image forming apparatus 100 will now be described.

Figure 4:
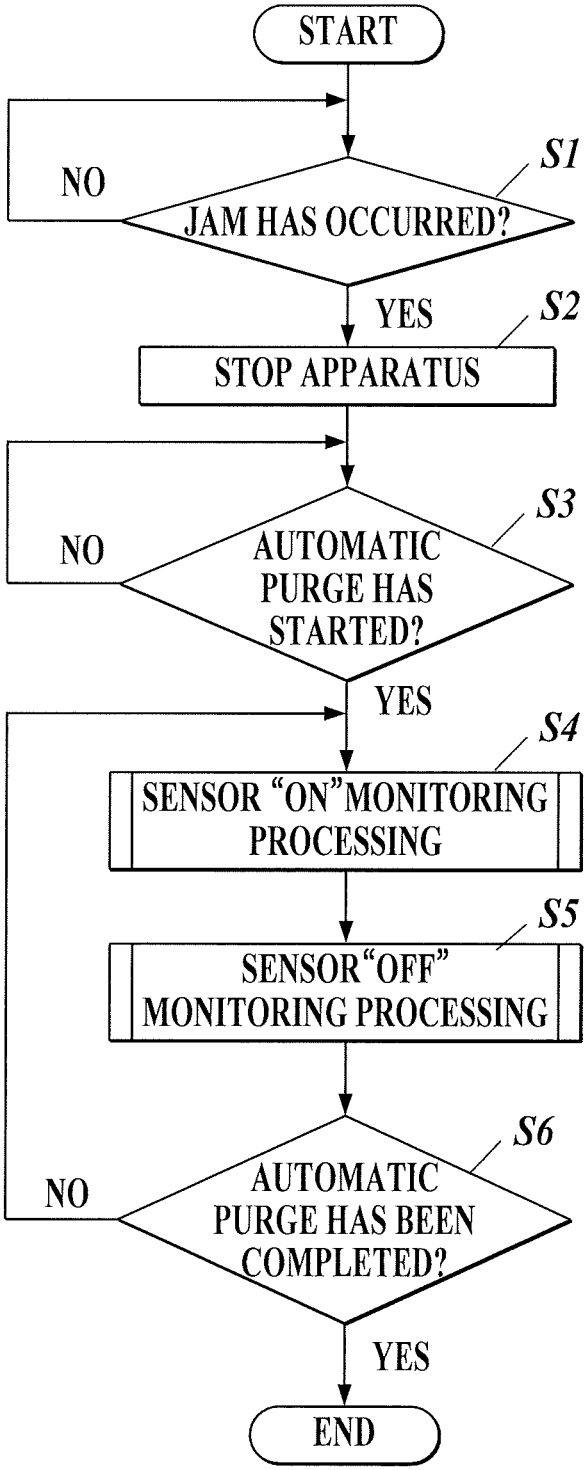
FIG. 4 is a flowchart showing path confirming processing at the time of an automatic purge.

FIG. 4 is a flowchart showing path confirming processing at the time of an automatic purge to be performed in the image forming apparatus 100. This processing is carried out by software processing through collaboration between the CPU and the programs stored in the ROM of the control unit 71.

The control unit 71 determines whether a jam has occurred based on the output results from the sheet detecting unit 75 (Step S1). If a jam has occurred (Step S1: YES), the control unit 71 stops the operations in the image forming apparatus 100 (Step S2). The control unit 71 determines the conveyance path information on all the subsections R1 to R10 stored in the storage unit 72 to be "unconfirmed".

A user then opens the front door of the image forming apparatus 100, pulls out the unit having the sheet that has caused the jam, and removes the sheet that has caused the jam. The user then put the pulled-out unit to an original position and closes the front door.

The control unit 71 then determines whether an automatic purge has started (Step S3). For example, an automatic purge starts when a user presses the start button of the operation unit 10 after removing the sheet that has caused the jam. If an automatic purge has started (Step S3: YES), the control unit 71 performs sensor "ON" monitoring processing (Step S4).

Figure 5:
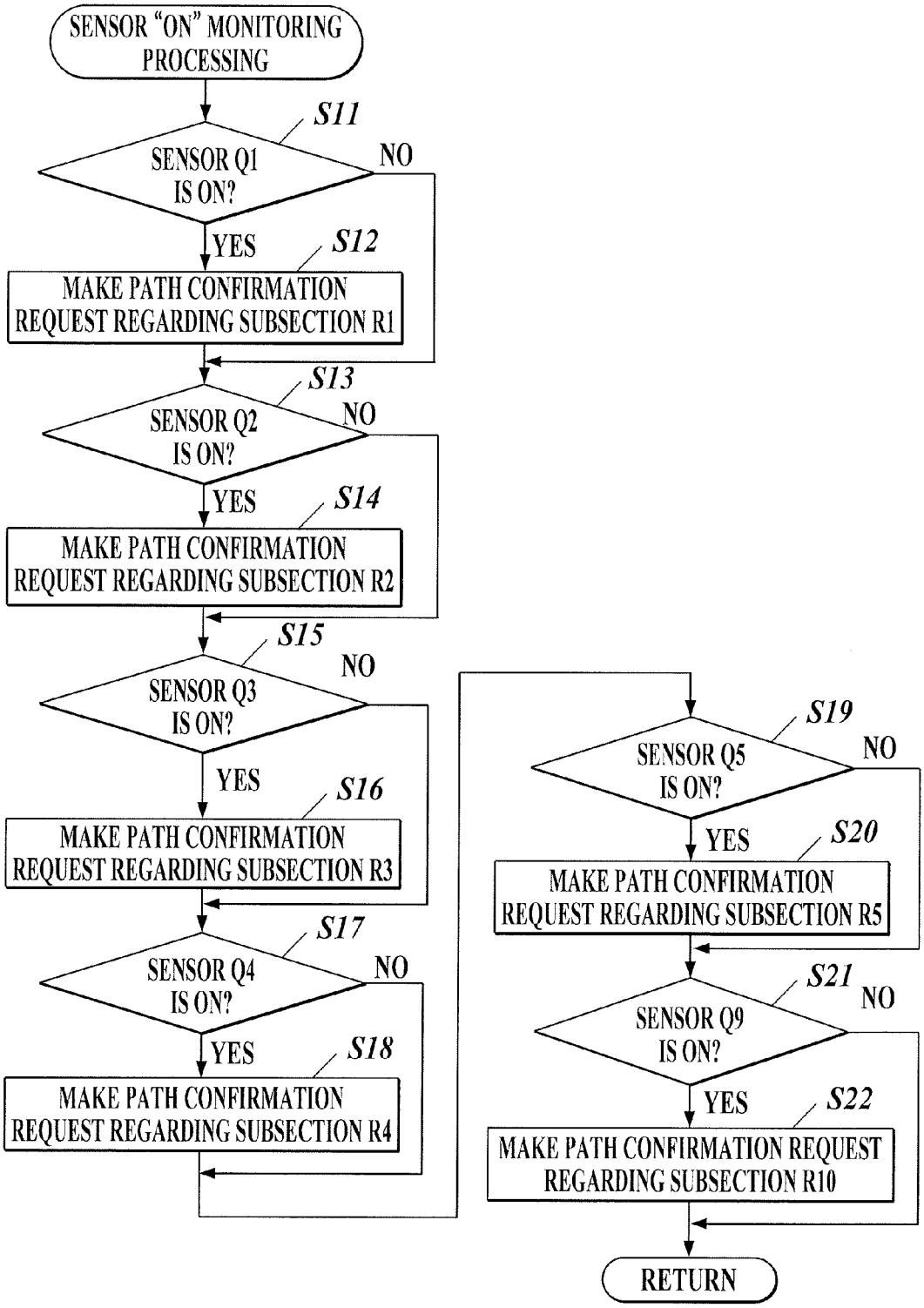
FIG. 5 is a flowchart showing sensor "ON" monitoring processing.

The sensor "ON" monitoring processing will now be described with reference to FIG. 5.

The control unit 71 determines whether the sensor Q1 is ON (Step S11). If the sensor Q1 is ON (Step S11: YES), the control unit 71 makes a path confirmation request regarding the subsection R1 (Step S12). Specifically, the control unit 71 changes the path confirmation request flag for the subsection R1 in the RAM to "ON". That is, the detection of a sheet by the sensor Q1 triggers the confirmation of the subsection R1.

If the sensor Q1 is not ON in Step S11 (Step S11: NO), or after Step S12, the control unit 71 determines whether the sensor Q2 is ON (Step S13). If the sensor Q2 is ON (Step S13: YES), the control unit 71 makes a path confirmation request regarding the subsection R2 (Step S14). Specifically, the control unit 71 changes the path confirmation request flag for the subsection R2 in the RAM to "ON".

If the sensor Q2 is not ON in Step S13 (Step S13: NO), or after Step S14, the control unit 71 determines whether the sensor Q3 is ON (Step S15). If the sensor Q3 is ON (Step S15: YES), the control unit 71 makes a path confirmation request regarding the subsection R3 (Step S16). Specifically, the control unit 71 changes the path confirmation request flag for the subsection R3 in the RAM to "ON".

If the sensor Q3 is not ON in Step S15 (Step S15: NO), or after Step S16, the control unit 71 determines whether the sensor Q4 is ON (Step S17). If the sensor Q4 is ON (Step S17: YES), the control unit 71 makes a path confirmation request regarding the subsection R4 (Step S18). Specifically, the control unit 71 changes the path confirmation request flag for the subsection R4 in the RAM to "ON".

If the sensor Q4 is not ON in Step S17 (Step S17: NO), or after Step S18, the control unit 71 determines whether the sensor Q5 is ON (Step S19). If the sensor Q5 is ON (Step S19: YES), the control unit 71 makes a path confirmation request regarding the subsection R5 (Step S20). Specifically, the control unit 71 changes the path confirmation request flag for the subsection R5 in the RAM to "ON".

If the sensor Q5 is not ON in Step S19 (Step S19: NO), or after Step S20, the control unit 71 determines whether the sensor Q9 is ON (Step S21). If the sensor Q9 is ON (Step S21: YES), the control unit 71 makes a path confirmation request regarding the subsection R10 (Step S22). Specifically, the control unit 71 changes the path confirmation request flag for the subsection R10 in the RAM to "ON".

If the sensor Q9 is not ON in Step S21 (Step S21: NO), or after Step S22, the sensor "ON" monitoring processing ends.

The sensor "ON" monitoring processing described above is for the case of the single-sided mode. In the case of the double-sided mode, the control unit 71 makes a path confirmation request regarding the subsection R6 if the sensor Q6 is ON, makes a path confirmation request regarding the subsection R7 if the sensor Q7 is ON, makes a path confirmation request regarding the subsection R8 if the sensor Q8 is ON, and makes a path confirmation request regarding the subsection R9 if, after sheet inversion, the sensor Q4 is ON.

After the sensor "ON" monitoring processing, the control unit 71 returns to the processing of FIG. 4 and performs sensor "OFF" monitoring processing (Step S5).

Figure 6:
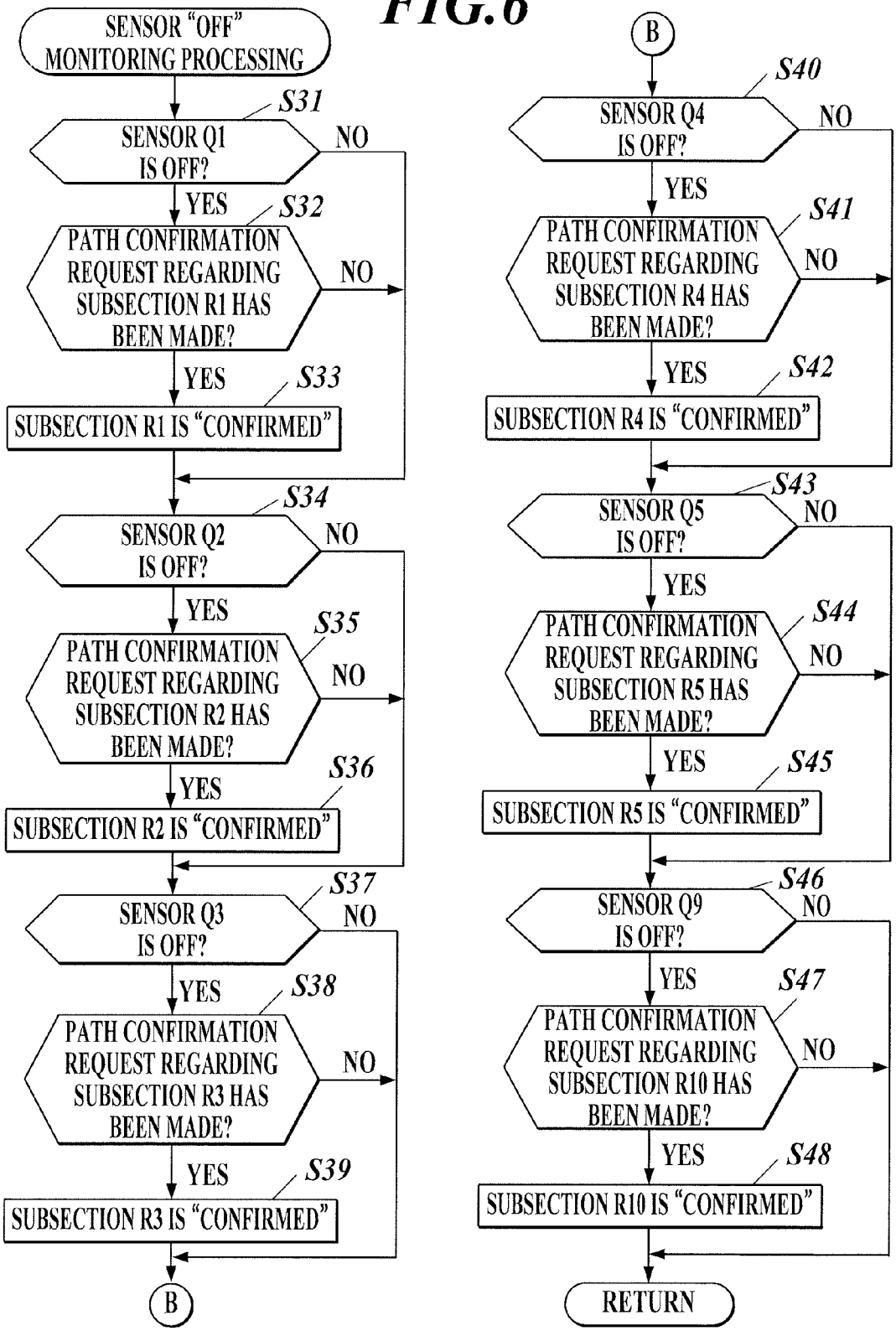
FIG. 6 is a flowchart showing sensor "OFF" monitoring processing.

The sensor "OFF" monitoring processing will now be described with reference to FIG. 6.

The control unit 71 determines whether the sensor Q1 is OFF (Step S31). If the sensor Q1 is OFF (Step S31: YES), the control unit 71 determines, in accordance with the path confirmation request flag for the subsection R1 in the RAM, whether a path confirmation request regarding the subsection R1 has been made (i.e., whether the path confirmation request flag is "ON") (Step S32). That is, the control unit 71 determines whether the sensor Q1 is ON in the sensor "ON" monitoring processing. If a path confirmation request regarding the subsection R1 has been made (Step S32: YES), the control unit 71 changes the conveyance path information on the subsection R1 stored in the storage unit 72 to "confirmed" (Step S33) and changes the path confirmation request flag for the subsection R1 in the RAM to "OFF".

If the sensor Q1 is not OFF in Step S31 (Step S31: NO) and if a path confirmation request regarding the subsection R1 has not been made in Step S32 (Step S32: NO), or after Step S33, the control unit 71 determines whether the sensor Q2 is OFF (Step S34). If the sensor Q2 is OFF (Step S34: YES), the control unit 71 determines whether a path confirmation request regarding the subsection R2 has been made (Step S35). If a path confirmation request regarding the subsection R2 has been made (Step S35: YES), the control unit 71 changes the conveyance path information on the subsection R2 stored in the storage unit 72 to "confirmed" (Step S36) and changes the path confirmation request flag for the subsection R2 in the RAM to "OFF".

If the sensor Q2 is not OFF in Step S34 (Step S34: NO) and if a path confirmation request regarding the subsection R2 has not been made in Step S35 (Step S35: NO), or after Step S36, the control unit 71 determines whether the sensor Q3 is OFF (Step S37). If the sensor Q3 is OFF (Step S37: YES), the control unit 71 determines whether a path confirmation request regarding the subsection R3 has been made (Step S38). If a path confirmation request regarding the subsection R3 has been made (Step S38: YES), the control unit 71 changes the conveyance path information on the subsection R3 stored in the storage unit 72 to "confirmed" (Step S39) and changes the path confirmation request flag for the subsection R3 in the RAM to "OFF".

If the sensor Q3 is not OFF in Step S37 (Step S37: NO) and if a path confirmation request regarding the subsection R3 has not been made in Step S38 (Step S38: NO), or after Step S39, the control unit 71 determines whether the sensor Q4 is OFF (Step S40). If the sensor Q4 is OFF (Step S40: YES), the control unit 71 determines whether a path confirmation request regarding the subsection R4 has been made (Step S41). If a path confirmation request regarding the subsection R4 has been made (Step S41: YES), the control unit 71 changes the conveyance path information on the subsection R4 stored in the storage unit 72 to "confirmed" (Step S42) and changes the path confirmation request flag for the subsection R4 in the RAM to "OFF".

If the sensor Q4 is not OFF in Step S40 (Step S40: NO) and if a path confirmation request regarding the subsection R4 has not been made in Step S41 (Step S41: NO), or after Step S42, the control unit 71 determines whether the sensor Q5 is OFF (Step S43). If the sensor Q5 is OFF (Step S43: YES), the control unit 71 determines whether a path confirmation request regarding the subsection R5 has been made (Step S44). If a path confirmation request regarding the subsection R5 has been made (Step S44: YES), the control unit 71 changes the conveyance path information on the subsection R5 stored in the storage unit 72 to "confirmed" (Step S45) and changes the path confirmation request flag for the subsection R5 in the RAM to "OFF".

If the sensor Q5 is not OFF in Step S43 (Step S43: NO) and if a path confirmation request regarding the subsection R5 has not been made in Step S44 (Step S44: NO), or after Step S45, the control unit 71 determines whether the sensor Q9 is OFF (Step S46). If the sensor Q9 is OFF (Step S46: YES), the control unit 71 determines whether a path confirmation request regarding the subsection R10 has been made (Step S47). If a path confirmation request regarding the subsection R10 has been made (Step S47: YES), the control unit 71 changes the conveyance path information on the subsection R10 stored in the storage unit 72 to "confirmed" (Step S48) and changes the path confirmation request flag for the subsection R10 in the RAM to "OFF".

If the sensor Q9 is not OFF in Step S46 (Step S46: NO) and if a path confirmation request regarding the subsection R10 has not been made in Step S47 (Step S47: NO), or after Step S48, the sensor "OFF" monitoring processing ends.

The sensor "OFF" monitoring processing described above is for the case of the single-sided mode. In the case of the double-sided mode, if the sensor Q6 is OFF and a path confirmation request regarding the subsection R6 has been made, the control unit 71 changes the conveyance path information on the subsection R6 to "confirmed"; if the sensor Q7 is OFF and a path confirmation request regarding the subsection R7 has been made, the control unit 71 changes the conveyance path information on the subsection R7 to "confirmed"; if the sensor Q8 is OFF and a path confirmation request regarding the subsection R8 has been made, the control unit 71 changes the conveyance path information on the subsection R8 to "confirmed"; and if, after sheet inversion, the sensor Q4 is OFF and a path confirmation request regarding the subsection R9 has been made, the control unit 71 changes the conveyance path information on the subsection R9 to "confirmed".

After the sensor "OFF" monitoring processing, the control unit 71 returns to the processing of FIG. 4 and determines whether the automatic purge has been completed (Step S6). If the automatic purge has not been completed (Step S6: NO), the control unit 71 returns to Step S4 and repeats the processing.

If the automatic purge has been completed in Step S6 (Step S6: YES), the path confirming processing at the time of automatic purge ends.

Example 1 of Update of Conveyance Path Information

An example 1 of update of conveyance path information is described with reference to FIGS. 7 to 10.

Figure 7:
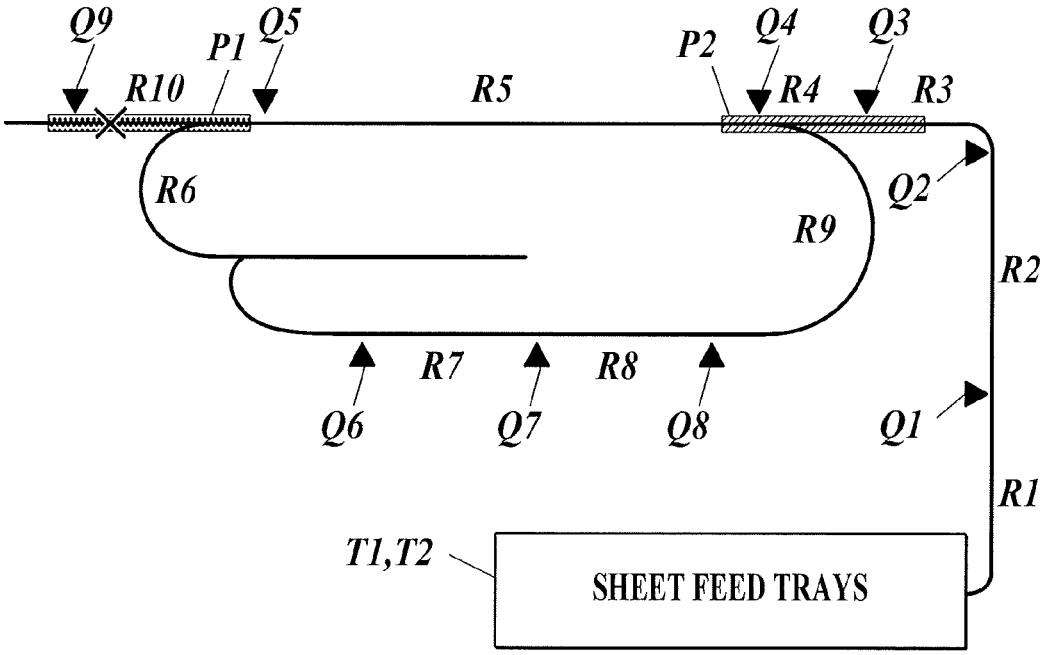
FIG. 7 shows example positions of sheets when a jam occurs.

FIG. 7 shows example positions of sheets when a jam has occurred near the sensor Q9. A sheet P1 is a sheet that has caused the jam and a sheet P2 is a remaining sheet remaining on the conveyance path when the jam is detected.

Figure 8:
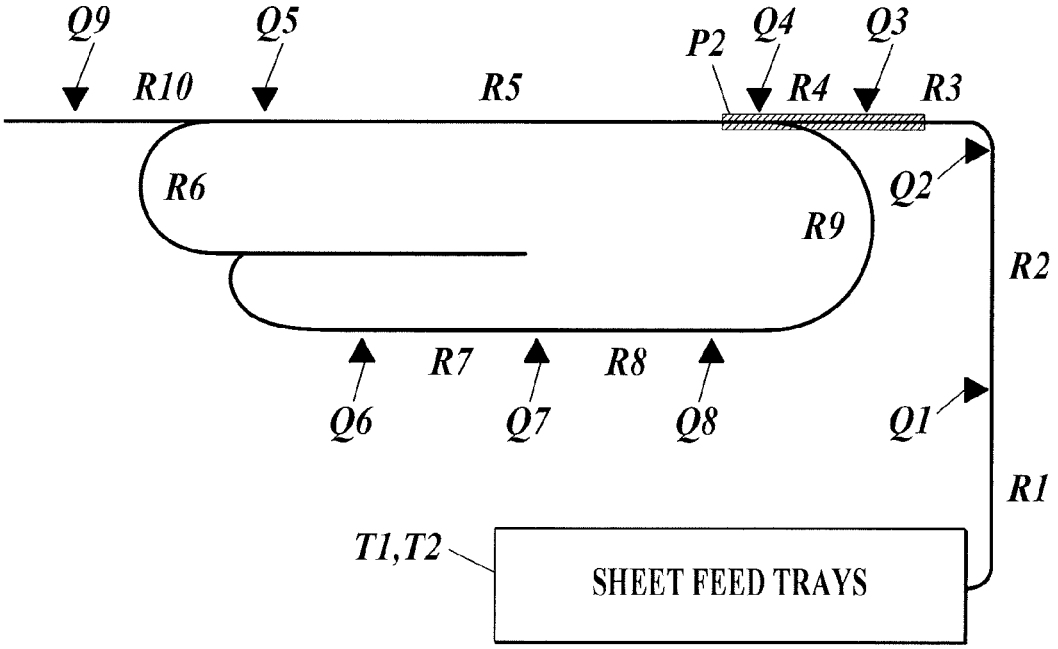
FIG. 8 shows a state after the removal of a sheet that has caused a jam.

FIG. 8 shows a state in which the sheet P1 has been removed by a user from the state of FIG. 7. An automatic purge (i.e., a forced ejection of the sheet P2) is then started.

Figure 9:
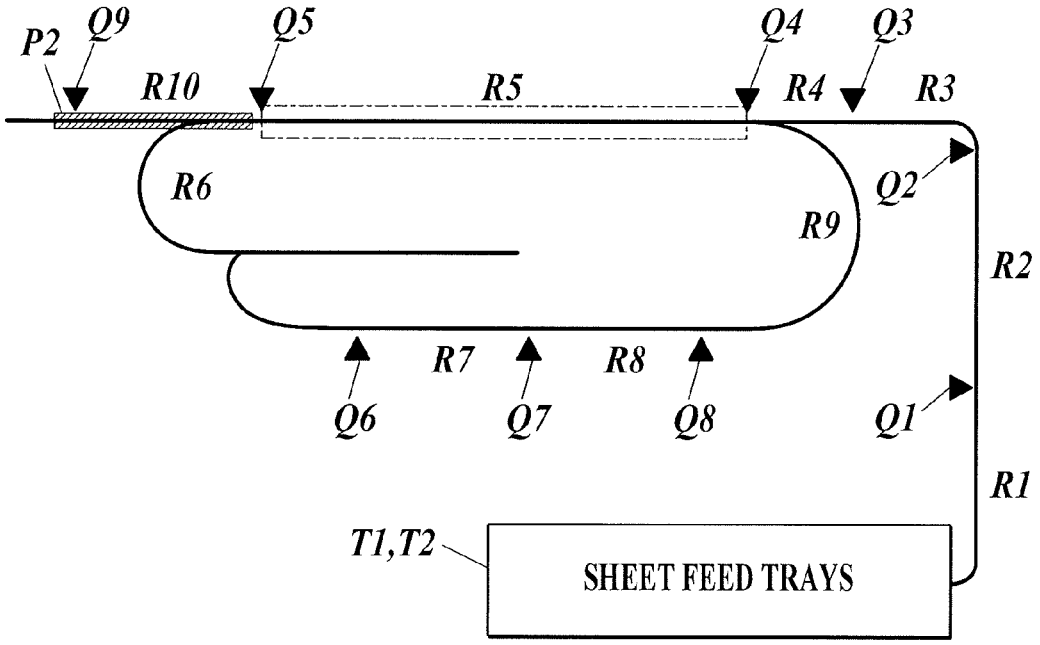
FIG. 9 shows a state in which the rear edge of a remaining sheet has passed the sensor Q5.

FIG. 9 shows a state in which the rear edge of the sheet P2 has passed the sensor Q5. The output of the sensor Q5 becomes "ON" and then becomes "OFF" due to the passage of the sheet P2 while the sheet P2 is conveyed from the position shown in FIG. 8 to the position shown in FIG. 9. Accordingly, the conveyance path information on the subsection R5 is updated into "confirmed".

Figure 10:
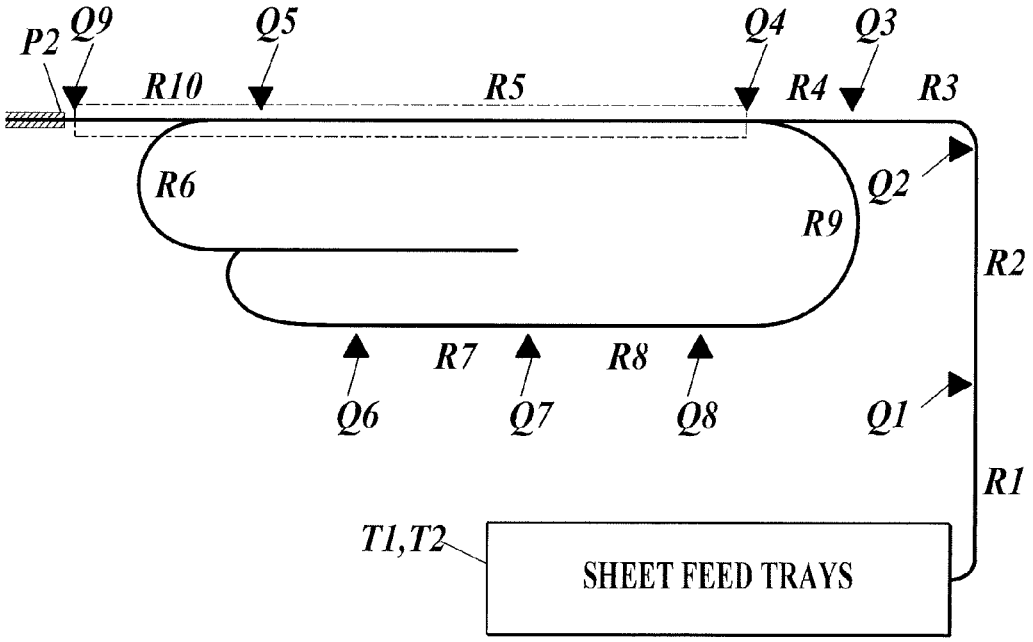
FIG. 10 shows a state in which the rear edge of a remaining sheet has passed the sensor Q9.

FIG. 10 shows a state in which the rear edge of the sheet P2 has passed the sensor Q9. The output of the sensor Q9 becomes "ON" and then becomes "OFF" due to the passage of the sheet P2 while the sheet P2 is conveyed from the position shown in FIG. 8 through the position shown in FIG. 9 to the position shown in FIG. 10. Accordingly, the conveyance path information on the subsection R10 is updated into "confirmed". That is, the ejection of the sheet P2 assures that there are no remaining sheets on the subsections R5 and R10 and that the subsections R5 and R10 are passable.

Example 2 of Update of Conveyance Path Information

An example 2 of update of conveyance path information is described with reference to FIGS. 11 to 14.

Figure 11:
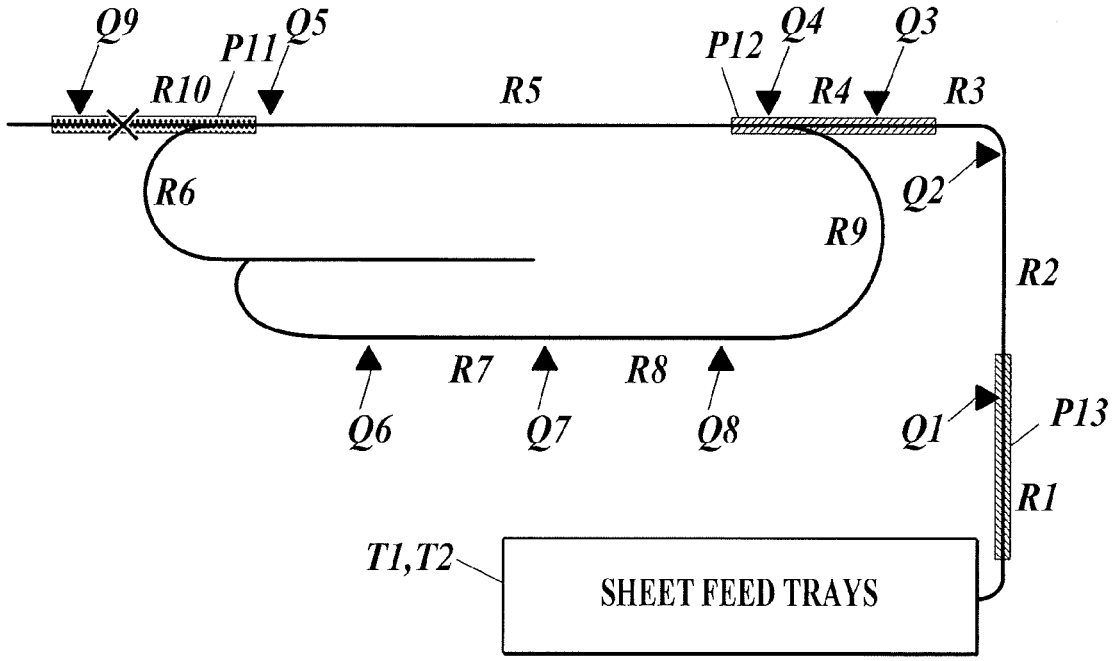
FIG. 11 shows other example positions of sheets when a jam occurs.

FIG. 11 shows example positions of sheets when a jam has occurred near the sensor Q9. A sheet P11 is a sheet that has caused the jam and sheets P12 and P13 are remaining sheets remaining on the conveyance path when the jam is detected.

When the sheet P11 is removed by a user from the state shown in FIG. 11, an automatic purge (i.e., a forced ejection of the sheets P12 and P13) is started.

Figure 12:
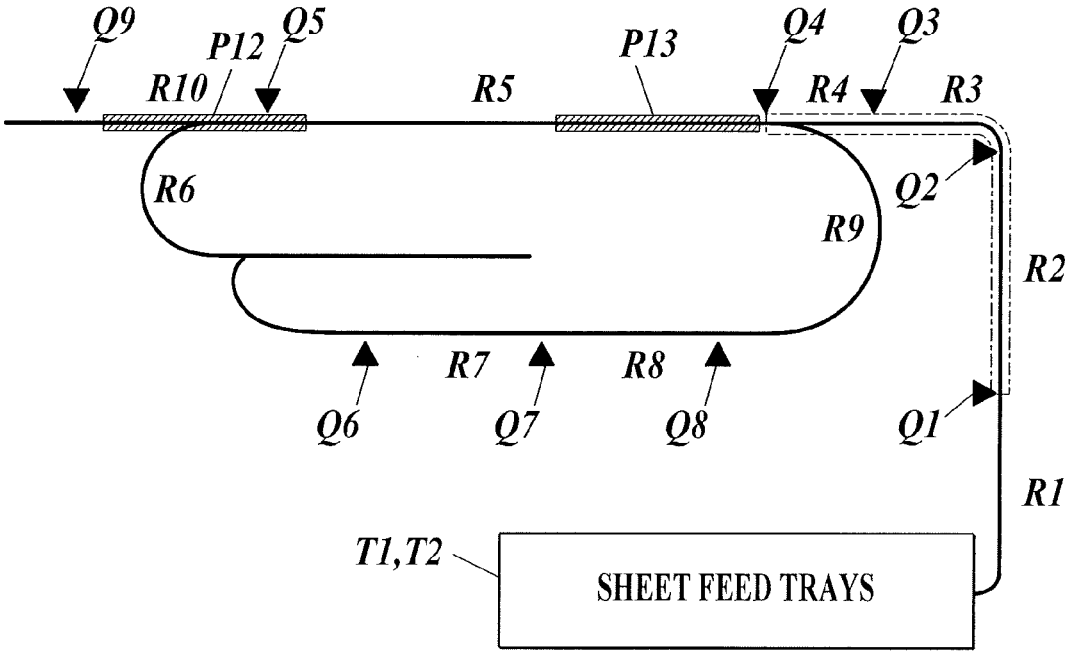
FIG. 12 shows a state in which the rear edge of the second remaining sheet has passed the sensor Q4.

FIG. 12 shows a state in which the rear edge of the sheet P13 (i.e., the second remaining sheet) has passed the sensor Q4. The output of the sensor Q2 becomes "ON" and then becomes "OFF" due to the passage of the sheet P13 while the sheet P13 is conveyed from the position shown in FIG. 11 to the position shown in FIG. 12. Accordingly, the conveyance path information on the subsection R2 is updated into "confirmed". Further, the output of the sensor Q3 becomes "ON" and then becomes "OFF" due to the passage of the sheet P13, and accordingly the conveyance path information on the subsection R3 is updated into "confirmed". Further, the output of the sensor Q4 becomes "ON" and then becomes "OFF" due to the passage of the sheet P13, and accordingly the conveyance path information on the subsection R4 is updated into "confirmed".

Figure 13:
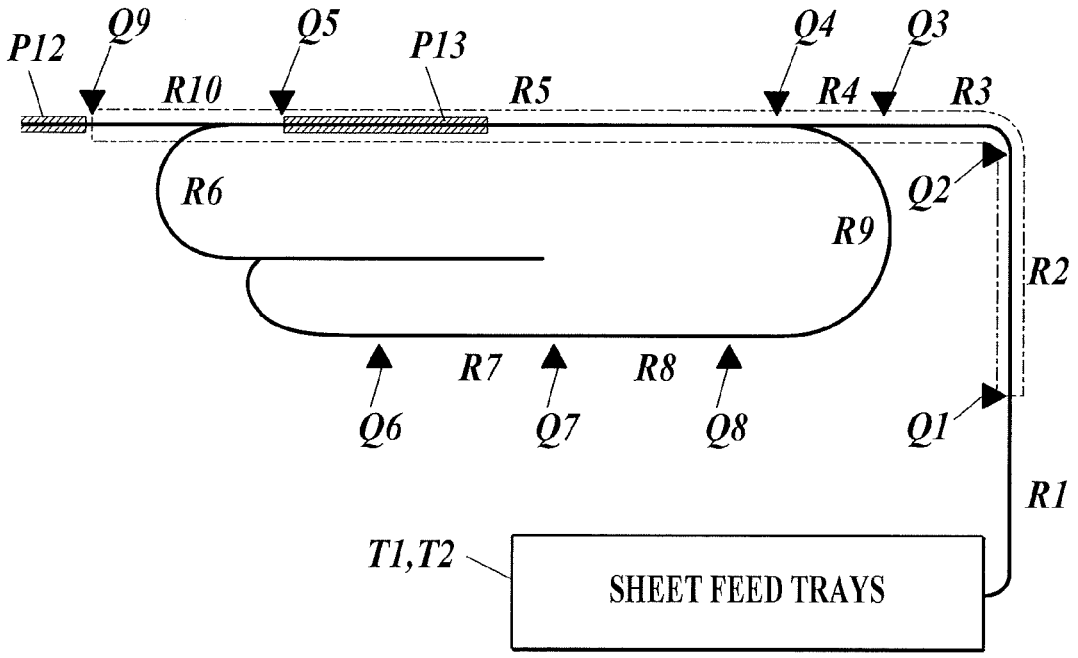
FIG. 13 shows a state in which the rear edge of the first remaining sheet has passed the sensor Q9.

FIG. 13 shows a state in which the rear edge of the sheet P12 (i.e., the first remaining sheet) has passed the sensor Q9. The output of the sensor Q5 becomes "ON" and then becomes "OFF" due to the passage of the sheet P12 while the sheet P12 is conveyed from the position shown in FIG. 11 through the position shown in FIG. 12 to the position shown in FIG. 13. Accordingly, the conveyance path information on the subsection R5 is updated into "confirmed". Further, the output of the sensor Q9 becomes "ON" and then becomes "OFF" due to the passage of the sheet P12, and accordingly the conveyance path information on the subsection R10 is updated into "confirmed". That is, the ejection of the sheets P12 and P13 assures that there are no remaining sheets on the subsections R2, R3, R4, R5, and R10 and that the subsections R2, R3, R4, R5, and R10 are passable.

Figure 14:
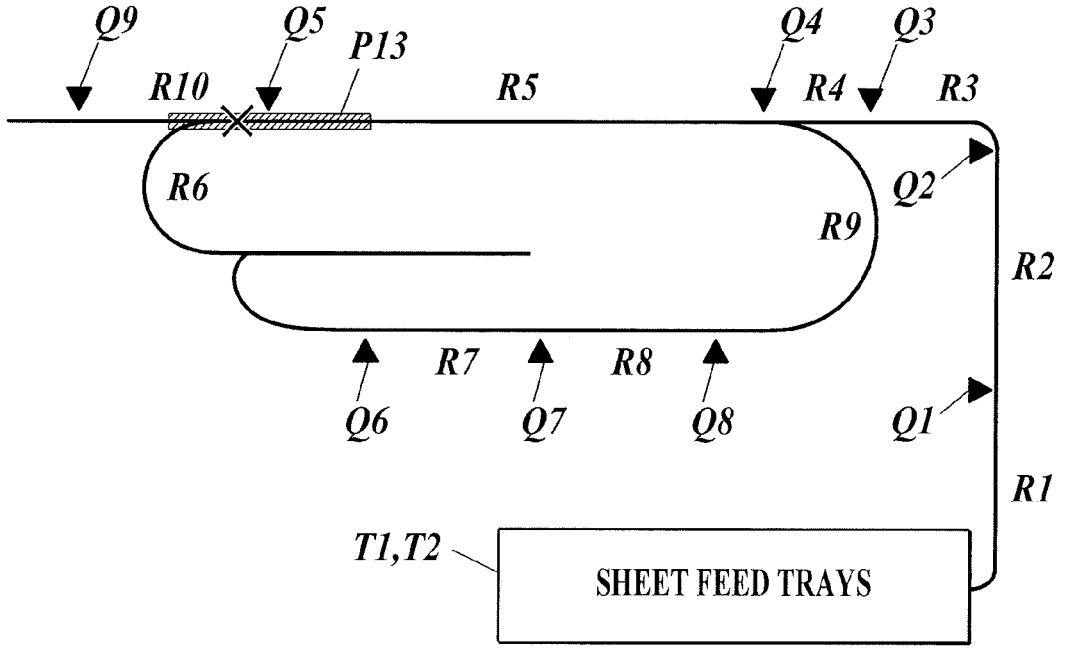
FIG. 14 shows a case in which a jam has occurred at the second remaining sheet.

If a jam occurs when the front edge of the sheet P13 (i.e., the second remaining sheet) is between the sensors Q9 and Q5 after the ejection of the sheet P12 (i.e., the first remaining sheet) has been completed as shown in FIG. 14, the conveyance path information on the subsections R2, R3, R4, R5, and R10, which has been determined to be "confirmed", is changed to "unconfirmed". The conveyance path information on the subsection R10 may be changed to "confirmed" when a user removes the sheet P13 that has caused the new jam since non-existence of remaining sheets is confirmed due to the removal of the sheet P13.

Figure 15:
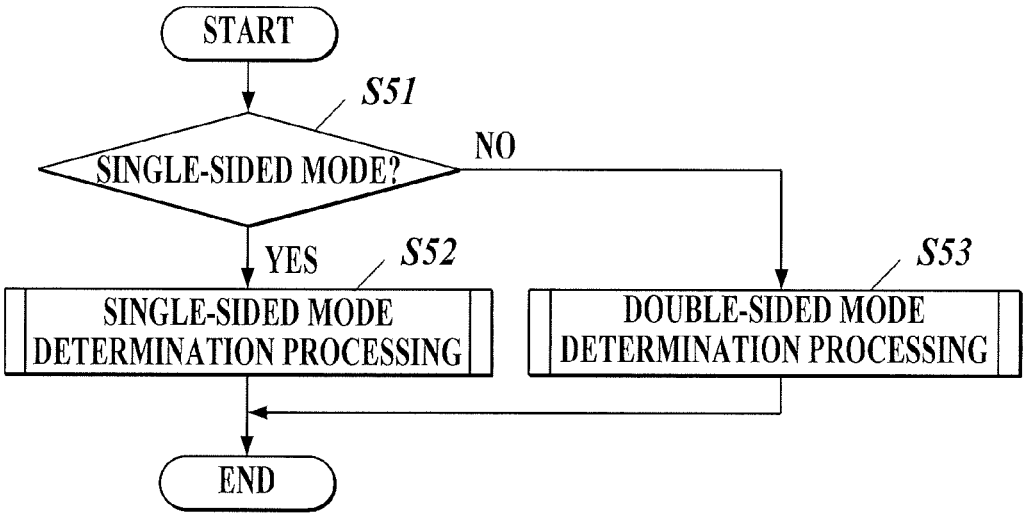
FIG. 15 is a flowchart showing processing of determining the timing of regular sheet feeding.

FIG. 15 is a flowchart showing processing of determining the timing of regular sheet feeding to be performed in the image forming apparatus 100. This processing confirms the subsections where remaining sheets have passed at the time of an automatic purge and determines when to start sheet feeding at normal intervals (i.e., regular sheet feeding) after the recovery from a jam. This processing is carried out by software processing through collaboration between the CPU and the programs stored in the ROM of the control unit 71.

The control unit 71 determines whether the mode is a single-sided mode (Step S51).

If the mode is a single-sided mode (Step S51: YES), the control unit 71 performs single-sided mode determination processing (Step S52).

The single-sided mode determination processing will now be described with reference to FIG. 16. In the single-sided mode determination processing, the subsections R10, R5, R4, R3, R2, and R1 of the conveyance path are checked.

The control unit 71 determines whether the subsection R10 has been confirmed in accordance with the conveyance path information on the subsection R10 stored in the storage unit 72 (Step S61). If the subsection R10 has not been confirmed (Step S61: NO), the control unit 71 determines that feeding of the second and subsequent sheets (i.e., regular sheet feeding) can be started upon completion of the ejection of the first sheet (Step S62). That is, when the ejection of the first sheet for image formation is completed after the recovery from a jam, the subsequent sheets are fed to be at normal intervals.

If the subsection R10 has been confirmed in Step S61 (Step S61: YES), the control unit 71 determines that feeding of the second and subsequent sheets (i.e., regular sheet feeding) can be started at the time when the output of the sensor Q5 becomes "ON" (Step S63).

The control unit 71 then determines whether the subsection R5 has been confirmed in accordance with the conveyance path information on the subsection R5 stored in the storage unit 72 (Step S64). If the subsection R5 has been confirmed (Step S64: YES), the control unit 71 determines that feeding of the second and subsequent sheets (i.e., regular sheet feeding) can be started at the time when the output of the sensor Q4 becomes "ON" (Step S65).

The control unit 71 then determines whether the subsection R4 has been confirmed in accordance with the conveyance path information on the subsection R4 stored in the storage unit 72 (Step S66). If the subsection R4 has been confirmed (Step S66: YES), the control unit 71 determines that feeding of the second and subsequent sheets (i.e., regular sheet feeding) can be started at the time when the output of the sensor Q3 becomes "ON" (Step S67).

The control unit 71 then determines whether the subsection R3 has been confirmed in accordance with the conveyance path information on the subsection R3 stored in the storage unit 72 (Step S68). If the subsection R3 has been confirmed (Step S68: YES), the control unit 71 determines that feeding of the second and subsequent sheets (i.e., regular sheet feeding) can be started at the time when the output of the sensor Q2 becomes "ON" (Step S69).

The control unit 71 then determines whether the subsection R2 has been confirmed in accordance with the conveyance path information on the subsection R2 stored in the storage unit 72 (Step S70). If the subsection R2 has been confirmed (Step S70: YES), the control unit 71 determines that feeding of the second and subsequent sheets (i.e., regular sheet feeding) can be started at the time when the output of the sensor Q1 becomes "ON" (Step S71).

The control unit 71 then determines whether the subsection R1 has been confirmed in accordance with the conveyance path information on the subsection R1 stored in the storage unit 72 (Step S72). If the subsection R1 has been confirmed (Step S72: YES), the control unit 71 determines that the regular sheet feeding can be started from the first sheet for image formation (i.e., the first sheet after the recovery) after the recovery from the jam (Step S73).

If the subsection R5 has not been confirmed in Step S64 (Step S64: NO), if the subsection R4 has not been confirmed in Step S66 (Step S66: NO), if the subsection R3 has not been confirmed in Step S68 (Step S68: NO), if the subsection R2 has not been confirmed in Step S70 (Step S70: NO), if the subsection R1 has not been confirmed in Step S72 (Step S72: NO), or after Step 62 or Step 73, the single-sided mode determination processing ends.

Reverting to FIG. 15, if the mode is not the single-sided mode in Step S51 (Step S51: NO), i.e., if the mode is the double-sided mode, the control unit 71 performs double-sided mode determination processing (Step S53).

The double-sided mode determination processing will now be described with reference to FIGS. 17 and 18. In the double-sided mode determination processing, the subsections R10, R9, R8, R7, R6, R5, R4, R3, R2, and R1 are checked.

The control unit 71 determines whether the subsection R10 has been confirmed in accordance with the conveyance path information on the subsection R10 stored in the storage unit 72 (Step S81). If the subsection R10 has not been confirmed (Step S81: NO), the control unit 71 determines that feeding of the second and subsequent sheets (i.e., regular sheet feeding) can be started upon completion of the ejection of the first sheet (Step S82).

If the subsection R10 has been confirmed in Step 81 (Step S81: YES), the control unit 71 determines that feeding of the second and subsequent sheets (i.e., regular sheet feeding) can be started at the time when the output of the sensor Q5 becomes "ON" after the inversion of the first sheet (Step S83).

The control unit 71 then determines whether the subsection R5 has been confirmed in accordance with the conveyance path information on the subsection R5 stored in the storage unit 72 (Step S84). If the subsection R5 has been confirmed (Step S84: YES), the control unit 71 determines that feeding of the second and subsequent sheets (i.e., regular sheet feeding) can be started at the time when the output of the sensor Q4 becomes "ON" after the inversion of the first sheet (Step S85).

The control unit 71 then determines whether the subsection R9 has been confirmed in accordance with the conveyance path information on the subsection R9 stored in the storage unit 72 (Step S86). If the subsection R9 has been confirmed (Step S86: YES), the control unit 71 determines that feeding of the second and subsequent sheets (i.e., regular sheet feeding) can be started at the time when the output of the sensor Q8 becomes "ON" (Step S87).

The control unit 71 then determines whether the subsection R8 has been confirmed in accordance with the conveyance path information on the subsection R8 stored in the storage unit 72 (Step S88). If the subsection R8 has been confirmed (Step S88: YES), the control unit 71 determines that feeding of the second and subsequent sheets (i.e., regular sheet feeding) can be started at the time when the output of the sensor Q7 becomes "ON" (Step S89).

The control unit 71 then determines whether the subsection R7 has been confirmed in accordance with the conveyance path information on the subsection R7 stored in the storage unit 72 (Step S90). If the subsection R7 has been confirmed (Step S90: YES), the control unit 71 determines that feeding of the second and subsequent sheets (i.e., regular sheet feeding) can be started at the time when the output of the sensor Q6 becomes "ON" (Step S91).

Going on to FIG. 18, the control unit 71 determines whether the subsection R6 has been confirmed in accordance with the conveyance path information on the subsection R6 stored in the storage unit 72 (Step S92). If the subsection R6 has been confirmed (Step S92: YES), the control unit 71 determines that feeding of the second and subsequent sheets (i.e., regular sheet feeding) can be started at the time when the output of the sensor Q5 becomes "ON" (Step S93).

The control unit 71 then determines whether the subsection R4 has been confirmed in accordance with the conveyance path information on the subsection R4 stored in the storage unit 72 (Step S94). If the subsection R4 has been confirmed (Step S94: YES), the control unit 71 determines that feeding of the second and subsequent sheets (i.e., regular sheet feeding) can be started at the time when the output of the sensor Q3 becomes "ON" (Step S95).

The control unit 71 then determines whether the subsection R3 has been confirmed in accordance with the conveyance path information on the subsection R3 stored in the storage unit 72 (Step S96). If the subsection R3 has been confirmed (Step S96: YES), the control unit 71 determines that feeding of the second and subsequent sheets (i.e., regular sheet feeding) can be started at the time when the output of the sensor Q2 becomes "ON" (Step S97).

The control unit 71 then determines whether the subsection R2 has been confirmed in accordance with the conveyance path information on the subsection R2 stored in the storage unit 72 (Step S98). If the subsection R2 has been confirmed (Step S98: YES), the control unit 71 determines that feeding of the second and subsequent sheets (i.e., regular sheet feeding) can be started at the time when the output of the sensor Q1 becomes "ON" (Step S99).

The control unit 71 then determines whether the subsection R1 has been confirmed in accordance with the conveyance path information on the subsection R1 stored in the storage unit 72 (Step S100). If the subsection R1 has been confirmed (Step S100: YES), the control unit 71 determines that the regular sheet feeding can be started from the first sheet after the recovery (Step S101).

If the subsection R5 has not been confirmed in Step S84 (Step S84: NO), if the subsection R9 has not been confirmed in Step S86 (Step S86: NO), if the subsection R8 has not been confirmed in Step S88 (Step S88: NO), if the subsection R7 has not been confirmed in Step S90 (Step S90: NO), if the subsection R6 has not been confirmed in Step S92 (Step S92: NO), if the subsection R4 has not been confirmed in Step S94 (Step S94: NO), if the subsection R3 has not been confirmed in Step S96 (Step S96: NO), if the subsection R2 has not been confirmed in Step S98 (Step S98: NO), if the subsection R1 has not been confirmed in Step S100 (Step S100: NO), or after Step 82 or Step 101, the double-sided mode determination processing ends.

Reverting to FIG. 15, the processing of determining the timing of regular sheet feeding ends after Step S52 or S53.

When an automatic purge is completed and the recovery sheet feeding is to be started, the control unit 71 allows the regular sheet feeding to be started at the timing determined by the processing of determining the timing of regular sheet feeding described above.

(Example of Determination of Non-Existence of Remaining Sheet)

Figure 16:
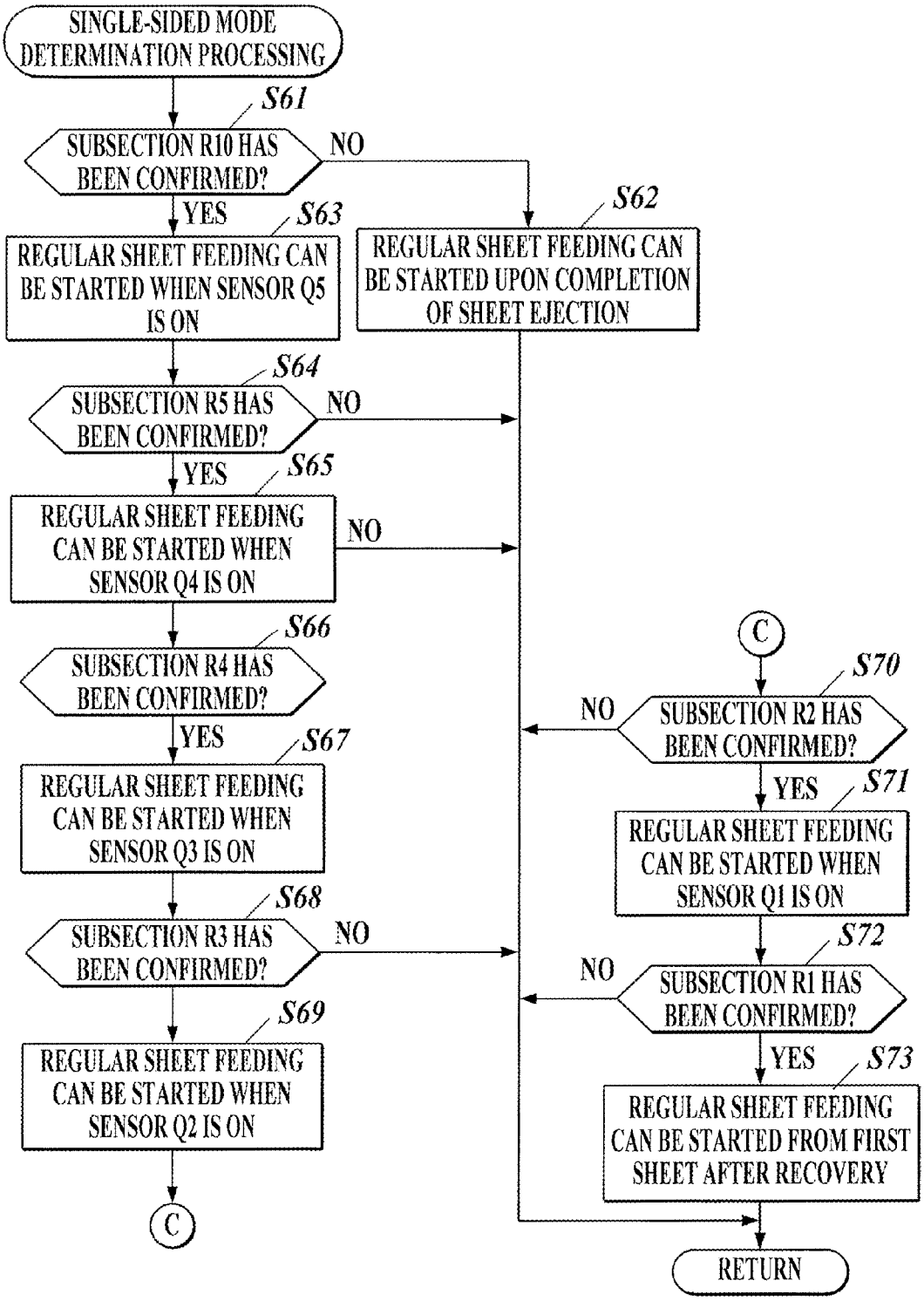
FIG. 16 is a flowchart showing single-sided mode determination processing.
Figure 19:
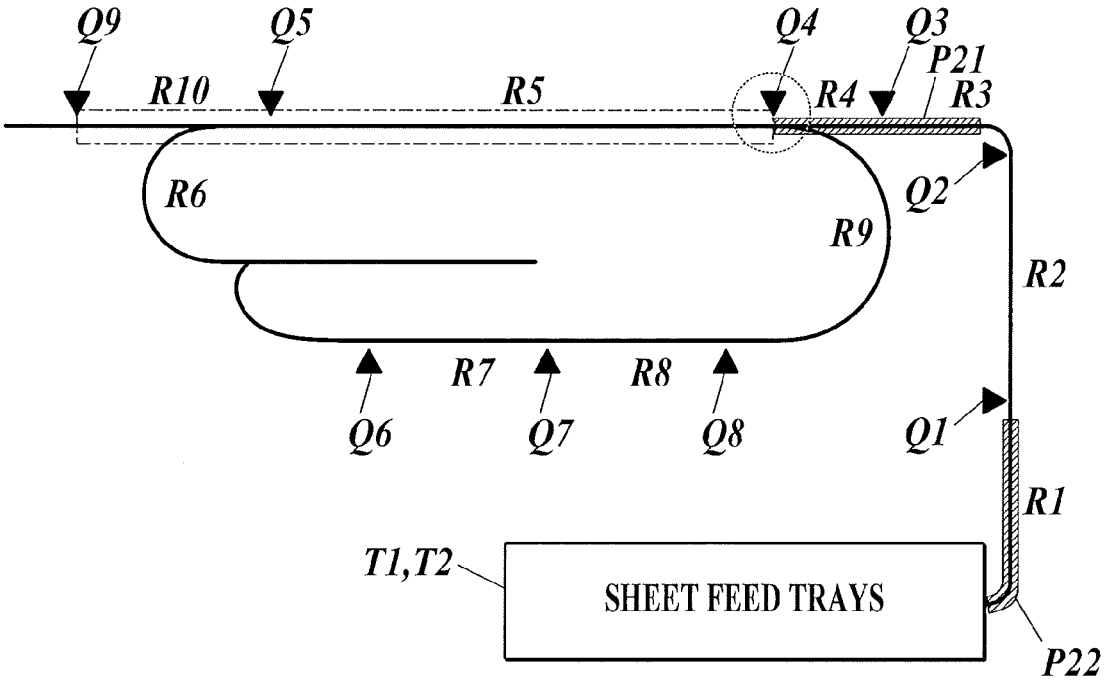
FIG. 19 shows a state in which the first sheet after recovery has reached the sensor Q4 when the subsections R10 and R5 have been confirmed to have no remaining sheets.

If the subsections R10 and R5 are determined to be confirmed as a result of an automatic purge in the single-sided mode (see FIGS. 7 to 10) as shown in FIG. 19, the feeding of the second sheet P22 after the recovery from the jam is started at the timing when the output of the sensor Q4 becomes "ON" due to the passage of the first sheet P21 after the recovery from the jam, the timing being determined by the single-sided mode determination processing (FIG. 16). If the sheet P21 reaches the sensor Q4, the subsections R10 and R5, which have been confirmed to be passable as a result of the automatic purge, are connected to the subsections R1 to R4, which have been confirmed to be passable by the passage of the sheet P21. It is thus confirmed that no remaining sheets exist in the apparatus.

As described above, in the first embodiment, the first sheet after the recovery is used to check existence or non-existence of remaining sheets. This can detect remaining sheets that remain to be ejected by the automatic purge, and can eliminate the need for wasteful ejection of sheets that would be needed if additional sheets for examination are used. Thus the status of the conveyance path can be checked without wasting sheets.

Further, in the first embodiment, the feeding of the second and subsequent sheets is started at the time when the first sheet after the recovery reaches a confirmed section that has been confirmed to have no remaining sheets at the time of an automatic purge. This can minimize the time required for the recovery from jams.

Further, in the first embodiment, the status of the conveyance path to be used can be efficiently checked, the conveyance path to be used varying depending on a mode, such as a single-sided mode and a double-sided mode. Specifically, if the whole of the conveyance path of the sheet to be fed next is a confirmed section, the regular sheet feeding can be started from the sheet to be fed next (Steps S73 and S101). Thus the time required for the recovery from a jam can be reduced. If, on the other hand, the conveyance path of the sheet to be fed next includes a part other than a confirmed section, the status of the part other than a confirmed section can be checked through the conveyance of the first sheet after the recovery.

The conveyance path information may be timely updated on subsections confirmed to have no remaining sheets through the sheet conveyance after the recovery. Specifically, the section where a sheet has been conveyed after the recovery is determined to be a confirmed section, in addition to the section confirmed to have no remaining sheets at the time of an automatic purge. If there is a mode change involving a change in conveyance path (i.e., involving a change to a conveyance path including an unconfirmed subsection) thereafter, the second and subsequent sheets may be fed when the first sheet after the mode change reaches the confirmed section.

Second Embodiment

A second embodiment of the present invention will now be described.

Since an image forming apparatus of the second embodiment has configuration similar to that of the image forming apparatus 100 of the first embodiment, FIGS. 1 to 3 are used for the second embodiment and the illustrations and explanations therefor are omitted. The description of the second embodiment set forth below focuses on the configuration and processing different from those of the first embodiment.

If a jam occurs in a single-sided mode where image formation is performed on one side of each sheet, the control unit 71 determines that the section of the conveyance path that is used only in a double-sided mode, where image formation is performed on both sides of each sheet, is a confirmed section.

In the second embodiment, if an automatic purge has started in Step S3 (Step S3: YES) in the path confirming processing at the time of automatic purge shown in FIG. 4, the control unit 71 determines whether the mode at the time of the occurrence of the jam is the single-sided mode.

If the mode at the time of the occurrence of the jam is the single-sided mode, the control unit 71 determines that no remaining sheets exist on the subsections R6, R7, R8, and R9, which subsections are used only in the double-sided mode. The control unit 71 then changes the conveyance path information on the subsections R6, R7, R8, and R9 stored in the storage unit 72 to "confirmed".

The other processing is the same as that of the first embodiment, and redundant explanations are omitted.

According to the second embodiment, if the mode at the time of occurrence of a jam is the single-sided mode, the section that is used only in the double-sided mode and thus assumed to have no sheets is determined to be a confirmed section. Accordingly, the status of the conveyance path can be efficiently checked. The second embodiment can also bring about the same advantageous effects as those obtained by the first embodiment.

The foregoing embodiments are exemplary image forming apparatuses according to the present invention but are not limitative. The details of the configurations and operations of the units constituting each apparatus may be modified as appropriate without departing from the spirit of the present invention.

For example, in each of the foregoing embodiments, the image forming apparatus includes the sheet feeding unit 50 and the sheet processing unit 60. Alternatively, the sheet feeding unit 50 and the sheet processing unit 60 may be provided as separate devices connected to the image forming apparatus. The image forming apparatus, the sheet feeding unit 50, and the sheet processing unit 60 may thus constitute an image forming system.

In the foregoing description, a ROM is used as a computer-readable medium containing a program to execute each processing. The computer-readable medium, however, is not limited to this example but may be a non-volatile memory, such as a flash memory, and a portable recording medium, such as a CD-ROM. Alternatively, a carrier wave may be used as a medium to provide program data via a communication line.

The entire disclosure of Japanese Patent Application No. 2014-239423 filed on Nov. 27, 2014 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

a sheet feeding unit which feeds a sheet, the sheet possessing a length in a conveying direction;

an image forming unit which performs image formation on the sheet;

a conveying unit which conveys the sheet in the conveying direction;

a plurality of sheet detectors which detect existence of the sheet, the sheet detectors being disposed on a conveyance path, the sheet detectors comprising at least a first sheet detector and a second sheet detector spaced apart downstream from the first sheet detector by a distance greater than the length of the sheet in the conveying direction;

a sheet ejection unit which, when a jam occurs on the conveyance path, ejects a remaining sheet remaining on the conveyance path after a sheet that has caused the jam is removed; and a control unit which stores, in a storage unit, information representing a confirmed section of the conveyance path, the confirmed section being a section of the conveying path spanning from the first sheet detector to the second sheet detector and confirmed to have no remaining sheet as a result of ejection of the remaining sheet, and which, when the first sheet detector detects a first sheet for the image formation that has reached the confirmed section after recovery from the jam, allows the sheet feeding unit to feed second and subsequent sheets.

2. The image forming apparatus according to claim 1, wherein, when a whole of the conveyance path of a sheet to be fed next is the confirmed section, the control unit allows the sheet feeding unit to feed the sheet to be fed next and a subsequent sheet; and when the conveyance path of the sheet to be fed next includes a part other than the confirmed section, the control unit allows the sheet feeding unit to feed the second and subsequent sheets when the sheet detector detects the first sheet that has reached the confirmed section.

3. The image forming apparatus according to claim 1, wherein, when a mode is a single-sided mode when the jam occurs, the control unit determines a section, which is used only in a double-sided mode, of the conveyance path to be the confirmed section, wherein the single-sided mode is a mode in which the image formation is performed on one side of the sheet, and wherein the double-sided mode is a mode in which the image formation is performed on both sides of the sheet.

4. An image forming system comprising:

a sheet feeding unit which feeds a sheet, the sheet possessing a length in a conveying direction;

a sheet processing unit which processes the sheet in a predetermined manner;

an image forming unit which performs image formation on the sheet;

a conveying unit which conveys the sheet in the conveying direction;

a plurality of sheet detectors which detect existence of the sheet, the sheet detectors being disposed on a conveyance path, the sheet detectors comprising at least a first sheet detector and a second sheet detector spaced apart downstream from the first sheet detector by a distance greater than the length of the sheet in the conveying direction;

a sheet ejection unit which, when a jam occurs on the conveyance path, ejects a remaining sheet remaining on the conveyance path after a sheet that has caused the jam is removed; and a control unit which stores, in a storage unit, information representing a confirmed section of the conveyance path, the confirmed section being a section of the conveying path spanning from the first sheet detector to the second sheet detector and confirmed to have no remaining sheet as a result of ejection of the remaining sheet, and which, when the first sheet detector detects a first sheet for the image formation that has reached the confirmed section after recovery from the jam, allows the sheet feeding unit to feed second and subsequent sheets.

5. The image forming system according to claim 4, wherein, when a whole of the conveyance path of a sheet to be fed next is the confirmed section, the control unit allows the sheet feeding unit to feed the sheet to be fed next and a subsequent sheet; and when the conveyance path of the sheet to be fed next includes a part other than the confirmed section, the control unit allows the sheet feeding unit to feed the second and subsequent sheets when the sheet detector detects the first sheet that has reached the confirmed section.

6. The image forming system according to claim 4, wherein, when a mode is a single-sided mode when the jam occurs, the control unit determines a section, which is used only in a double-sided mode, of the conveyance path to be the confirmed section, wherein the single-sided mode is a mode in which the image formation is performed on one side of the sheet, and wherein the double-sided mode is a mode in which the image formation is performed on both sides of the sheet.

7. An image forming method with an image forming apparatus including a sheet feeding unit which feeds a sheet, the sheet possessing a length in a conveying direction; an image forming unit which performs image formation on the sheet; a conveying unit which conveys the sheet in the conveying direction; a plurality of sheet detectors which detect existence of the sheet, the sheet detectors being disposed on a conveyance path, the sheet detectors comprising at least a first sheet detector and a second sheet detector spaced apart downstream from the first sheet detector by a distance greater than the length of the sheet in the conveying direction; a sheet ejection unit which, when a jam occurs on the conveyance path, ejects a remaining sheet remaining on the conveyance path after a sheet that has caused the jam is removed; and a control unit, the method comprising:

storing, with the control unit, information representing a confirmed section of the conveyance path in a storage unit, the confirmed section being a section of the conveying path spanning from the first sheet detector to the second sheet detector and confirmed to have no remaining sheet as a result of ejection of the remaining sheet; and allowing, with the control unit, the sheet feeding unit to feed second and subsequent sheets when the first sheet detector detects a first sheet for the image formation that has reached the confirmed section after recovery from the jam.

8. The image forming method according to claim 7, wherein the allowing includes:

allowing, with the control unit, the sheet feeding unit to feed a sheet to be fed next and a subsequent sheet when a whole of the conveyance path of the sheet to be fed next is the confirmed section; and allowing, with the control unit, the sheet feeding unit to feed the second and subsequent sheets when the sheet detector detects the first sheet that has reached the confirmed section when the conveyance path of the sheet to be fed next includes a part other than the confirmed section.

9. The image forming method according to claim 7, further comprising:

determining a section, which is used only in a double-sided mode, of the conveyance path to be the confirmed section with the control unit when a mode is a single-sided mode when the jam occurs, wherein the single-sided mode is a mode in which the image formation is performed on one side of the sheet, and wherein the double-sided mode is a mode in which the image formation is performed on both sides of the sheet.

* * * * *